US006332449B1

(12) United States Patent
Girard

(10) Patent No.: US 6,332,449 B1
(45) Date of Patent: Dec. 25, 2001

(54) DEVICE FOR CONTROLLING THE OPENING AND CLOSING OF AT LEAST AN INTERNAL COMBUSTION ENGINE CYLINDER HEAD AIR CONDUIT

(75) Inventor: Didier Girard, Menucourt (FR)

(73) Assignees: Automobiles, Peugeot, Paris; Automobiles Citroën, Neuilly sur Siene, both of (FR)

( * ) Notice: Subject to any disclaimer, the term of this patent is extended or adjusted under 35 U.S.C. 154(b) by 0 days.

(21) Appl. No.: 09/381,310

(22) PCT Filed: Jan. 28, 1999

(86) PCT No.: PCT/FR99/00160

§ 371 Date: Jan. 3, 2000

§ 102(e) Date: Jan. 3, 2000

(87) PCT Pub. No.: WO99/39091

PCT Pub. Date: Aug. 5, 1999

(30) Foreign Application Priority Data

Jan. 28, 1999 (FR) ..... 98 00992

(51) Int. Cl.[7] ..... F02D 9/16
(52) U.S. Cl. ..... 123/336; 123/190.5
(58) Field of Search ..... 123/336, 306, 123/188.14, 190.5, 190.6

(56) References Cited

U.S. PATENT DOCUMENTS 5,069,175 * 12/1991 Simko ..... 123/432
5,081,961 * 1/1992 Paul et al. ..... 123/51 B
5,596,966 * 1/1997 Elder ..... 123/337

FOREIGN PATENT DOCUMENTS

0480393 * 10/1991 (EP) .
725210 * 7/1996 (EP) .

OTHER PUBLICATIONS

SD/0177/1998.050/UK Technyl C 548B V15 Product sheet, May 1998, Rhodia Plastics, 2 pages.*

* cited by examiner

*Primary Examiner*—Henry C. Yuen
*Assistant Examiner*—Arnold Castro
(74) *Attorney, Agent, or Firm*—Connolly Bove Lodge & Hutz LLP

(57) ABSTRACT

A device comprising a cylindrical sliding gate (3), transversely arranged relative to the air conduit(s) (2) in a bore (4) arranged in a cylinder head (1) movable between a first position closing (P2) the conduit (2) and a second position opening (P1) the conduit (2) by the action of an actuating arrangement (16, 14; 17; 18, 19).

5 Claims, 5 Drawing Sheets

FIG. 8
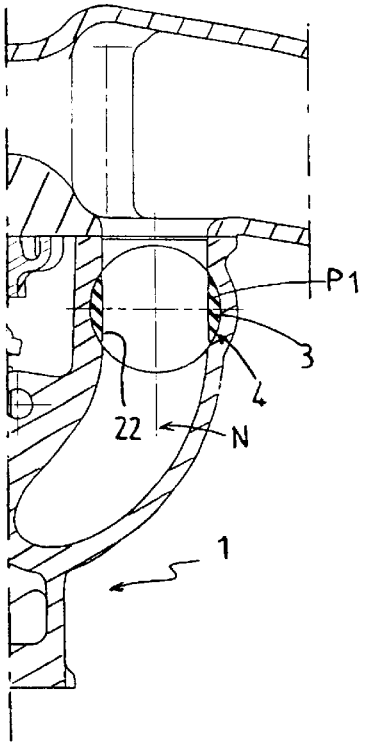
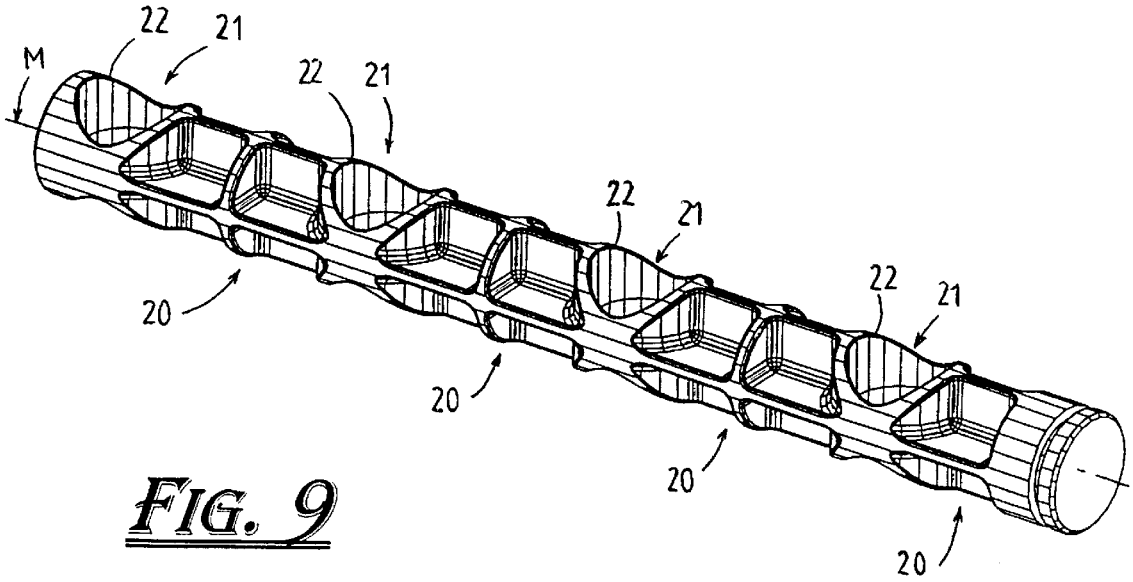
FIG. 9

DEVICE FOR CONTROLLING THE OPENING AND CLOSING OF AT LEAST AN INTERNAL COMBUSTION ENGINE CYLINDER HEAD AIR CONDUIT

FIELD OF THE INVENTION

This invention relates to a device for controlling the opening and closing of at least one internal combustion engine cylinder head air conduit.

BACKGROUND OF THE INVENTION

In general, devices for controlling the opening and closing of internal combustion engine air intake conduits are comprised of an axis arranged in the cylinder head that passes through the intake conduits and is equipped plumb over each conduit with a countersinking on which is attached, using two screws, a butterfly, that has the overall shape of a disk.

Such devices require many extremely precise millings in the cylinder head, as well as the particularly difficult mounting of the butterflies in the conduits which can for example produce the risk of losing the screws in the intake conduits, thus requiring a long and costly mounting process.

SUMMARY OF THE INVENTION

The object of this invention is to propose a device for controlling the opening and closing of a least one intake conduit that makes it possible to resolve the afore-mentioned inconveniences.

With this end in view, this invention relates to a device for controlling the opening and closing of at least one internal combustion engine cylinder head air intake conduit, characterized by the fact that it comprises a cylindrical sliding gate transversely arranged relative to the air conduit in a bore arranged in the cylinder head mobile between a first position closing the conduit and a second position opening said conduit by the action of actuating means.

The controlling device as set forth in the invention may also have one or several of the following characteristics:

the sliding gate is capable of moving in a translatory motion in the bore, the sliding gate is capable of moving in a rotational motion in the bore, for each conduit, the cylindrical sliding gate is comprised successively on its length, on the one hand of a first part creating a platform that, in a cross section, has the overall shape of a cross and on the other hand of a second part that is comprised of a vertical partition whose length is approximately equal to the diameter of a conduit, and each of these parts is delimited by two disks perpendicular to the longitudinal axis of the sliding gate, for each conduit, the sliding gate is comprised successively on its length, on the one hand of a first part creating a platform that, in a cross section, has the overall shape of a cross, and on the other hand of a second part that is comprised of a cylindrical part with a hole whose longitudinal symmetry axis is perpendicular to the longitudinal axis of the sliding gate and whose diameter is equal to the diameter of the corresponding air intake conduit, the sliding gate is comprised, on one of the parts that creates the platform, of a sliding gate foolproofing means in the bore making it possible to guarantee the appropriate position of said second parts plumb over the air intake conduits, the foolproofing means is comprised of a longitudinal groove that is capable of receiving the end of a guide screw that is attached to the cylinder head, the actuating means is comprised of a vacuum chamber created between one of the extremities of the cylinder head and a cover plate with a hole that creates a vacuum system that can be controlled by a calculator in response to the engine ratings, the actuating means is comprised of a small rod attached to one of the extremities of the sliding gate and linked to a vacuum cell actuated by a calculator in response to the engine ratings, the sliding gate is made of a one-piece set created by molding a plastic material that is capable of withstanding temperatures that are less than or equal to 100 degrees Celsius such as for example polyamide.

BRIEF DESCRIPTION OF THE DRAWINGS

The above-mentioned characteristics of the invention, as well as others, will appear more clearly upon reading the following description of several examples, while referring to the attached drawings where:

FIG. 8 is a front sectional view of an air intake conduit equipped with a performance variable of the controlling device, and FIG. 9 is a perspective view of the controlling device according to FIG. 8.

DESCRIPTION OF THE PREFERRED EMBODIMENT

Figure 1:
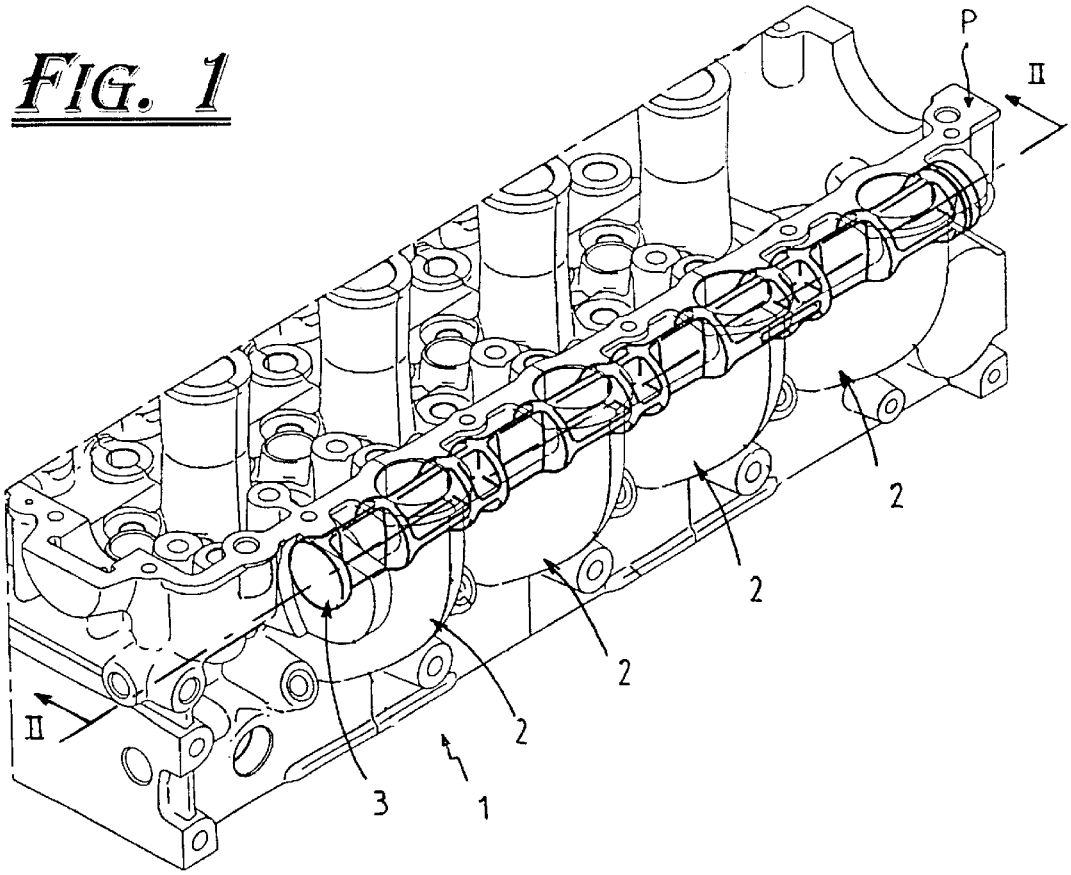
FIG. 1 is a partial perspective view of a cylinder head, of an internal combustion engine, equipped with the device for controlling the opening and closing of the air intake conduits as set forth in this invention.

FIG. 1 shows an internal combustion engine cylinder head that is equipped with conventional, intake conduits 2, for example four, arranged on one of the lateral faces of the cylinder head 1 and where each has the general shape of an elbow of which one of the orifices opens on the level of the horizontal joint plane P on which rests a cam shaft case, (not shown).

Figure 2:
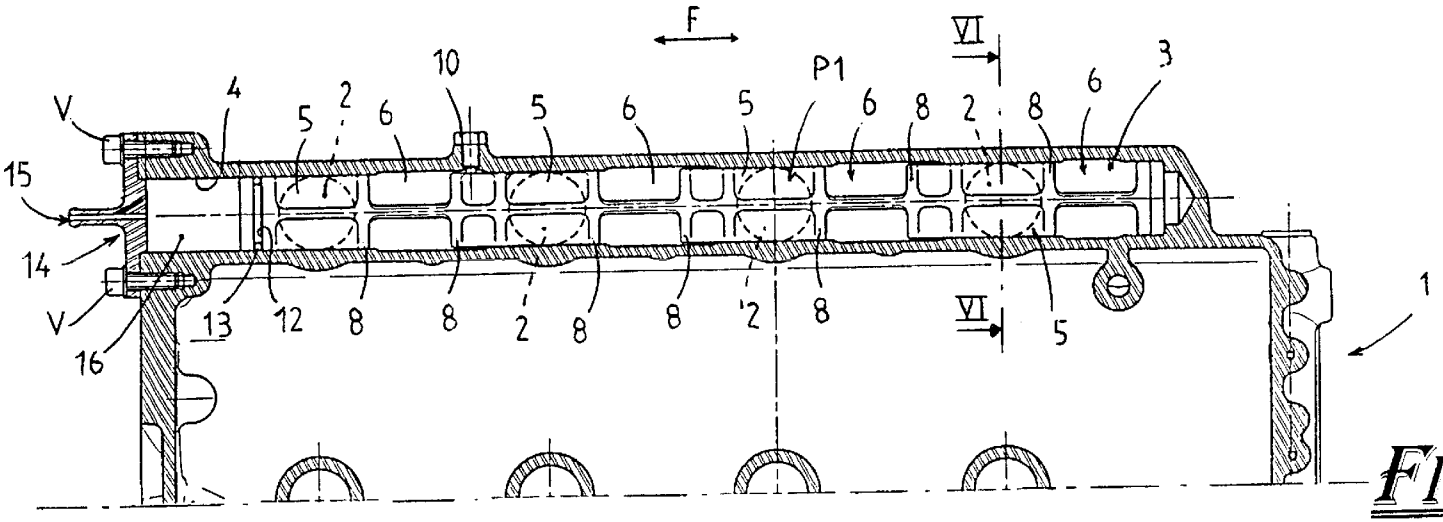
FIG. 2 is a sectional view along line II—II of the cylinder head in FIG. 1 equipped with an actuating means of the device in a translatory motion.

The cylinder head 1 is equipped, advantageously, with a device for controlling the opening and closing of the air intake conduits that is comprised, as set forth in this invention, of a cylindrical sliding gate 3 transversally arranged relative to the air conduits 2 in a bore 4, as can be seen in FIG. 2, arranged in a cylinder head 1 moveable between a first closing position P2 and a second opening position P1 of the conduit by the action of actuating means.

The bore 4 is comprised of a blind hole arranged so as to transversally pass through the intake conduits 2, as seen in FIG. 2.

The sliding gate 3 is made of a one-piece set by molding a plastic material that is capable of withstanding temperatures that are less than or equal to 100 degrees Celsius such as for example polyamide.

For each conduit, this sliding gate 3 is comprised successively comprises on its length a first part 5 creating a platform that, in a cross section, has the overall shape of a cross, and a second part 6 that is comprised of a vertical partition 7 whose length is approximately the same as that of the diameter of a conduit 2. Each of the parts 5, 6 are delimited by two disks perpendicular to the longitudinal axis M of the sliding gate 3.

Figure 3:
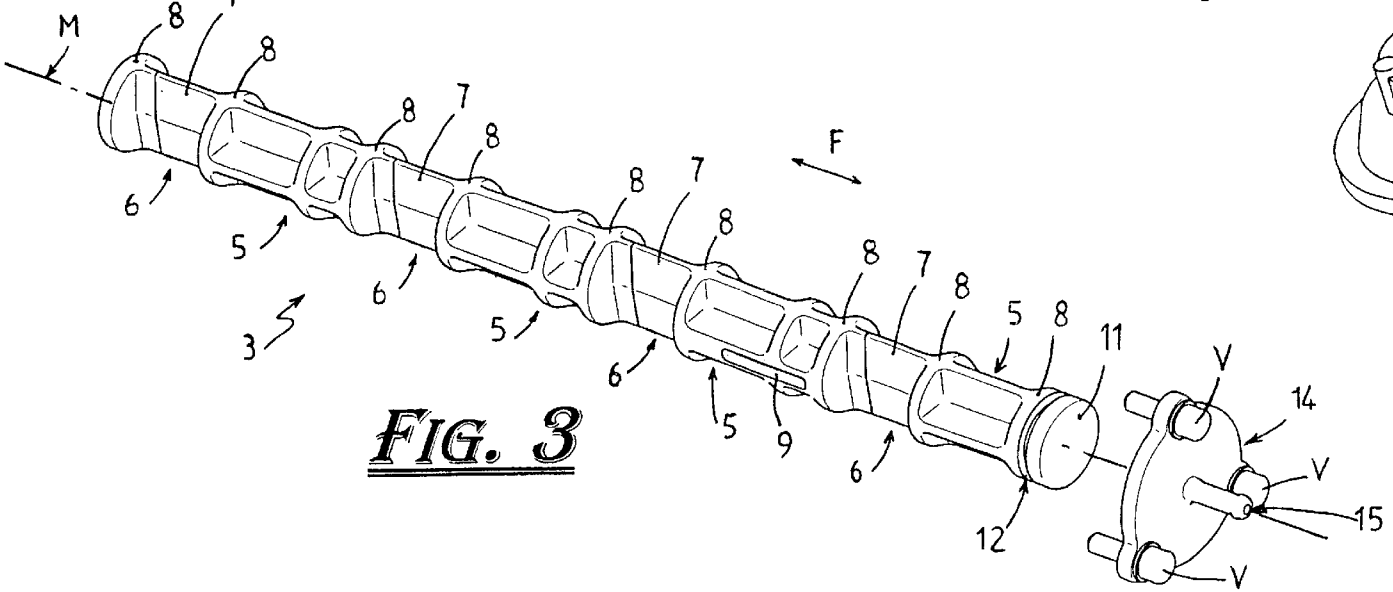
FIG. 3 is a perspective view of the device according to FIG. 2 without the cylinder head.

In order to assure the foolproofing of the vertical partition 7 of the second part 6 of the sliding gate 3 during the mounting of the latter in the bore, a foolproofing means is provided for on one of the arms that forms the cross of one of the first parts 5 that is comprised of a longitudinal groove 9, as can be seen in FIG. 3.

This groove 9 is capable of receiving the end of a guide screw 10 that is attached to the cylinder head 1, as can be seen in FIG. 2.

FIGS. 2 and 3 show actuating means of the sliding gate 3 that make it possible for the latter to move in a translatory motion inside the bore, in a direction represented by the arrow F.

With this end in view, the cylindrical sliding gate 3 is equipped at one of its ends 11 with a circular furrow 12 in which is mounted an O-ring 13 thus creating a piston.

A cover plate 14 is attached by screws V to the cylinder head 1 so as to close the blind hole 4 thus guaranteeing the tightness of the controlling device. This plate 14 has a hole 15 of small diameter that makes possible a vacuum connection in a chamber 16 created between the plate 14 and the end of the sliding gate 3 that form the piston. operation of the opening and closing control device of the invention will now be explained with reference to FIGS. 6, 7 and 2.

Figure 6:
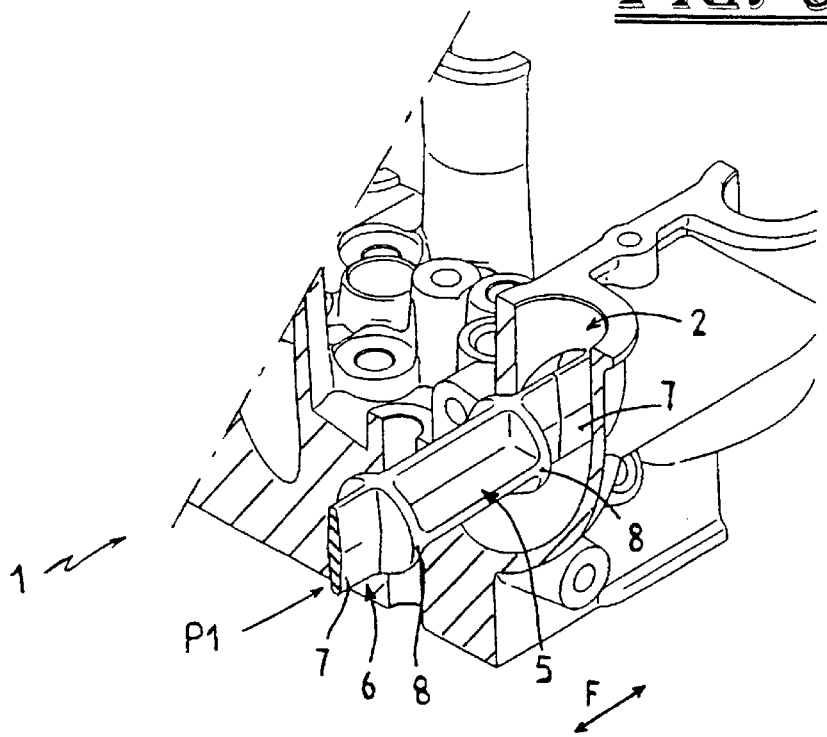
FIGS. 6 and 7 are partial perspective views of a cylinder head and the device according to lines VI—VI of FIG. 2, respectively in the position opening and in the position closing the air intake conduits.
Figure 7:
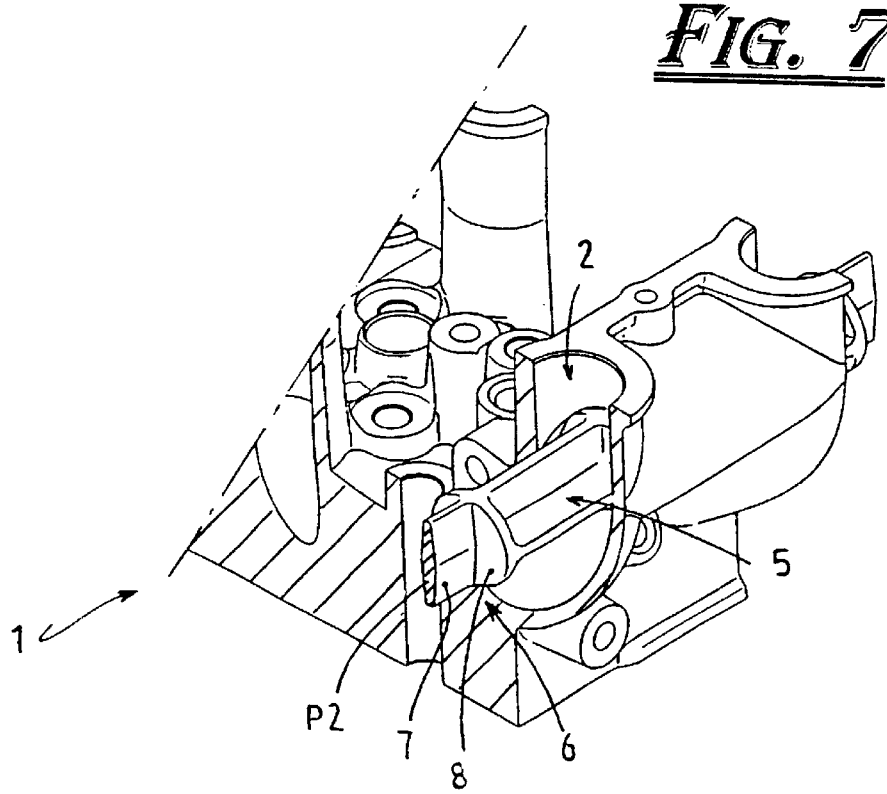

The control of air intake in the intake conduits 2 is assured by the cylindrical sliding gate 3 that is movable in a translatory motion between the first position P1 for example opening, as represented in FIG. 6, where the vertical partition 7 is arranged plumb over the air intake conduits 2 and a second closing position P2, as represented in FIGS. 7 and 2, where the first part 5 of the sliding gate 3 is arranged plumb over the air intake conduits 2.

This sliding gate 3 is actuated by a vacuum/over pressure system, in response to the engine ratings, arranged in the chamber 16 formed between the end 11 of the sliding gate and the cover plate 14 that is controlled for example by a calculator (not show).

The movement of the sliding gate 3 is controlled in a variable manner between the two opening (P1) and closing (P2) positions of the air intake conduits 2.

Figure 4:
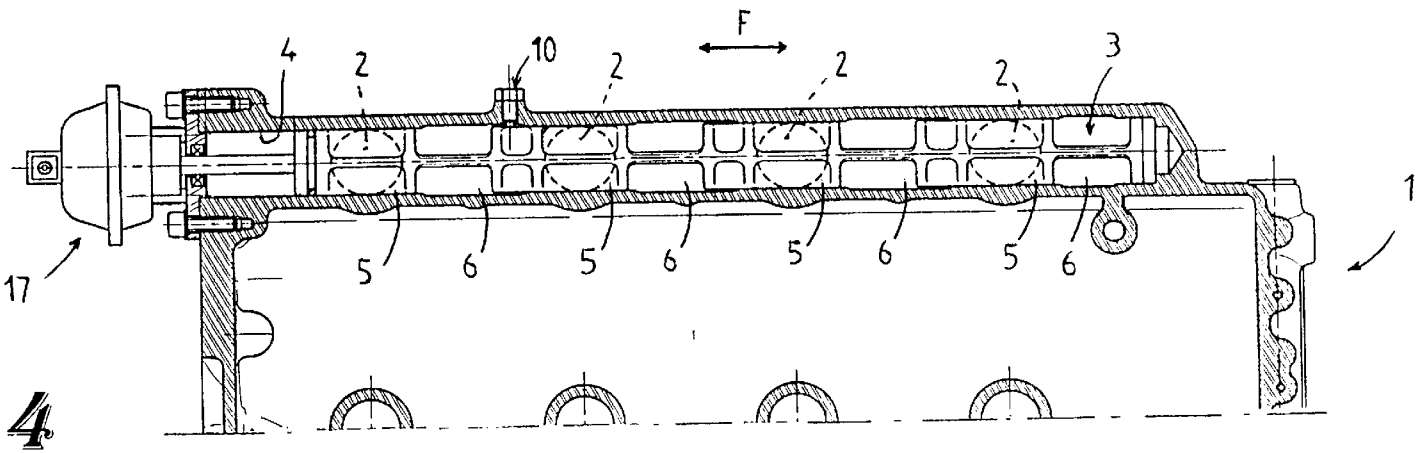
FIG. 4 is a view similar to FIG. 2, equipped according to a variable with an actuating means in a translatory motion.

FIG. 4 shows a variant of the actuating means of the sliding gate 3, in which the vacuum chamber 16 is replaced by a vacuum cap 17 mounted at the end of the bore 4 making it possible to move the sliding gate 3 in a translatory motion, in the direction of the arrow F, in response to the engine ratings controlled by a calculator (not shown).

Figure 5:
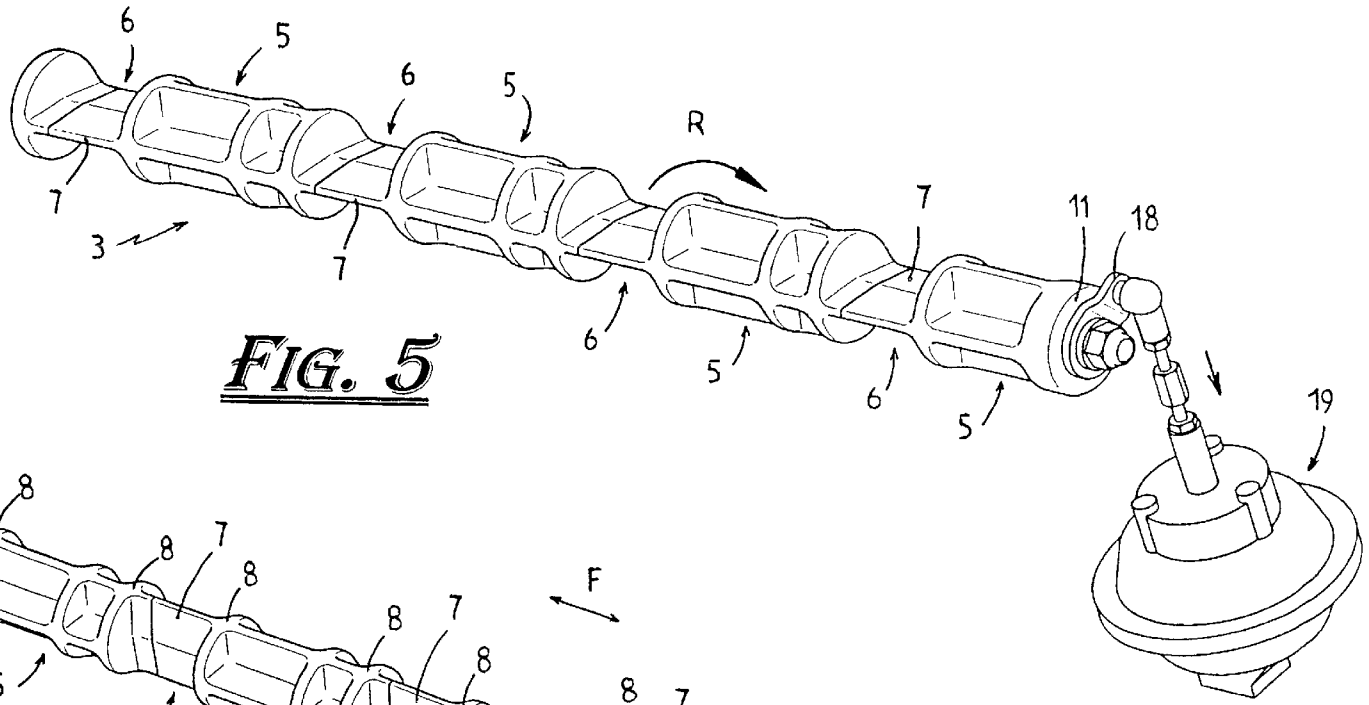
FIG. 5 is a perspective view of the device for controlling the opening and closing and its actuating means in a rotational motion, without the cylinder head.

Another variant of the actuating means is represented in FIG. 5, in which the translatory motion is replaced by a rotational motion, (arrow R). These actuating means are for example comprised of a small rod 18 attached to one of the ends 11 of the sliding gate 3 that is linked to a vacuum cap 19 that is actuated in response to the engine ratings controlled by a calculator.

FIGS. 8 and 9 show another variant of the controlling sliding gate 3 that makes it possible, advantageously, not to disrupt the air flow in the air intake conduit 2.

The shape of the sliding gate 3 is arranged so that it will be completely erased from the air conduit in the opening position P1, as can be seen in FIG. 8.

For each conduit 2, this sliding gate 3 is comprised successively over its length of a first part 20 creating a platform that, in a cross section, has the overall shape of a cross, and, of a second part 21 that is comprised of a cylindrical rod with a hole 22 whose longitudinal symmetry axis N is perpendicular to the longitudinal axis M of the sliding gate 3 and whose diameter is equal to the diameter of the corresponding air intake conduit, as can be seen in FIG. 8.

The sliding gate 3 can be moved in a translatory motion or a rotational motion according to the above-described actuating means or equivalent means.

From reading the above description, it will be understood that the controlling device of the invention advantageously allows for an easier and less expensive mounting in the cylinder head.

What is claimed is:

1. A device for controlling opening and closing of at least one internal combustion engine cylinder head air intake conduit, said device comprising:

a cylindrical sliding gate transversally arranged relative to at least one air conduit in a bore arranged in the cylinder head; the gate slidably movable in the bore between a first position closing the conduit and a second position opening said conduit;

actuating means for slidably moving the gate between the first and second positions;

for each conduit, said cylindrical sliding gate successively comprising on its length a first part creating a generally cruciform platform and a second part that is comprised of a vertical partition whose length is approximately equal to a diameter of a conduit, each of said first and second parts being delimited by two disks perpendicular to a longitudinal axis of the sliding gate.

2. The device as set forth in claim 1, wherein the sliding gate further comprises, on one of the parts creating a platform, means to assure correct positioning of said second part over the air intake conduits.

3. The device as set forth in claim 1, wherein the sliding gate is made of a one-piece set of molded plastic material capable of withstanding temperatures less than or equal to 100° C.

4. A device for controlling opening and closing of at least one internal combustion engine cylinder head air intake conduit, said device comprising;

a cylindrical sliding gate transversally arranged relative to at least one air conduit in a bore arranged in the cylinder head; the gate slidably movable in the bore between a first position closing the conduit and a second position opening said conduit;

actuating means for slidably moving the gate between the first and second positions;

for each conduit, said sliding gate successively comprising on its length a first part creating a generally cruciform platform, and a second part that is comprised of a cylindrical rod with a hole whose longitudinal axis of symmetry is perpendicular to the longitudinal axis of the sliding gate and whose diameter is equal to the diameter of a corresponding air intake conduit.

5. The device as set forth in claim 4, wherein the sliding gate further comprises, on one of the parts creating a platform, means to assure correct positioning of said second part over the air intake conduits.

* * * * *